United States Patent [19]

Alexeenko et al.

[11] Patent Number: 4,804,334

[45] Date of Patent: Feb. 14, 1989

[54] ZERO INSERTION FORCE ELECTRICAL CONNECTOR

[76] Inventors: Boris V. Alexeenko, Poselok Balabino, ulitsa Shkolnaya, 90, Zaporozhskaya Oblast; Gennady V. Nikolaenko, Prospekt Lenina, 38, kv. 42, Zaporozhie, both of U.S.S.R.

[21] Appl. No.: 72,341

[22] Filed: Jul. 13, 1987

[30] Foreign Application Priority Data

Jul. 14, 1986 [SU] U.S.S.R. ..... 4091261

[51] Int. Cl.[4] ..... H01R 9/09

[52] U.S. Cl. ..... 439/260; 439/267; 439/636

[58] Field of Search ..... 439/59–62, 439/260, 267, 325–328, 629–637

[56] References Cited

U.S. PATENT DOCUMENTS

| | | | |
|---|---|---|---|
| 3,744,005 | 7/1973 | Sitzler | 439/260 |
| 4,076,362 | 2/1978 | Ichimura | 439/260 |
| 4,080,027 | 3/1978 | Benasutti | 439/260 |
| 4,275,944 | 6/1981 | Sochor | 439/267 |
| 4,327,955 | 5/1982 | Minter | 439/260 |
| 4,400,049 | 8/1983 | Schlick | 439/634 |
| 4,505,528 | 3/1985 | Reimer | 439/61 |

*Primary Examiner*—J. Patrick McQuade
*Attorney, Agent, or Firm*—Lilling & Greenspan

[57] ABSTRACT

A connector comprises a housing having a longitudinal slot in a top wall thereof for receiving a member being switched. Secured to a lower wall of the housing are contacts placed in recesses provided in side walls of the housing. The housing has a longitudinal passageway for reciprocations of a key therein for opening and closing the contacts. The key is made in the form of a rod having a projection which engages with inner surfaces of arms of the contacts when the key is moved. Projections are made on a wall of each recess, the outside surfaces thereof being embraced by the inner surfaces of the arms of the contacts when they are opened.

2 Claims, 3 Drawing Sheets

ZERO INSERTION FORCE ELECTRICAL CONNECTOR

BACKGROUND OF THE INVENTION

1. Field of the Invention

The present invention relates to demountable connectors of electric circuits of printed circuit boards, and in particular, to a zero insertion force electrical connector.

The invention may be used for electrical connection within a unit or between units in electronic equipment using printed circuit boards and switching devices.

2. Description of the Prior Art

In widely-known zero insertion force electrical connectors using cam mechanisms, worm gears, sliding bar mechanisms, the force required to open contacts by some mechanism is a factor which limits the permissible number of contact positions. Designing zero insertion force electrical connectors is complicated by eventual warping, scatter of tolerances and out-of-planeness of the circuit boards being connected. Furthermore, known connectors have mechanisms for opening contacts of complicated design, the manufacture thereof is complicated, and they have low reliability in operation.

Known in the art is a zero insertion force electrical connector (GB, B, No. 1542889) comprising a support supporting an insulator housing and a row of contacts, a cam bar extending along the contacts, a drive mechanism for longitudinally shifting the bar, a cooperating means which provides engagement between the cam bar and support during longitudinal movement on the bar and which diagonally moves the bar away from the support to spread the contacts. The contacts are closed upon reversing rotation of the drive mechanism.

Simultaneous opening and closure of all contacts results in an increased mechanical load on the drive mechanism which limits the number of contacts used in the connector, causes intensive wear of the drive mechanism and makes the connector design more complicated.

Known in the art is a zero insertion force electrical connector (DE, B, No. 2707122) comprising an insulator housing having recesses in which elastic contacts are mounted and a U-shaped longitudinal slot for receiving a bar which compresses the contacts and which forms a means for closing the contacts. Another embodiment of this connector comprises vertically movable cams mounted opposite to each pair of contacts and driven by a bar or slider.

According to a first embodiment of the connector, contacts are closed due to a movement of the bar which compresses them. This results in a gradual increase in a force produced by closure of the entire group of contacts. Shifting the cams which compress the contacts by means of the bar or slider makes it possible to reduce the force produced by closure of contacts. But a second embodiment of the connector is of a complex design. Furthermore, mechanical stresses produced in the contacts are at maximum when the contacts are closed, which results in a residual deformation of the connector contacts causing a poor connection with a member being switched during operation.

Known in the art is a zero insertion force electrical connector (U.S. Pat. No. 4,275,944) comprising an insulator housing having a longitudinal slot in a top wall thereof for receiving a mating member. Secured in a lower wall of the housing are elastic contacts placed in side walls of the housing. The housing also has a longitudinal passageway for reciprocations of a key therein for opening and closing elastic contacts. The key is made in the form of a rod having a constant cross-sectional area of its working portion.

Each contact has bowed arms engageable with a member being switched and projections for mounting the contacts in the recesses. Placed between the contact arms along the connector are flexible inserts which define the passageway for movement of the key therein.

Despite of the fact that the friction force of the key decreases during opening of the contact arms due to the provision of inserts disposed between the key and inner end faces of the contact arms, the insertion force of the key increases with an increase in the number of open contacts which limits the admissible number of contacts in the connector.

SUMMARY OF THE INVENTION

It is an object of the invention to increase the number of contacts in the connector.

It is another object of the invention to improve reliability of connection between the contacts and conductors of a member being switched.

It is still another object of the invention to prolong life of the connector.

The invention resides in that in a zero insertion force electrical connector comprising an insulator housing having a longitudinal slot in a top wall thereof for receiving a member being switched, elastic contacts placed in recesses provided in side walls of the housing and secured in a lower wall of the housing, and a key for opening and closing the elastic contacts. The longitudinal passageway, is made in the housing, for reciprocations of the key therein. According to the invention, the key is made in the form of a rod having at least one ellipsoidal projection which cooperates with inner end faces of arms of the elastic contacts when the key is moved and which has opposing lateral curved edges symmetrical with respect to the longitudinal axis of the rod, and projections are made on the wall of each recess which faces towards the end portion of the key as it moves in the direction of opening of the elastic contacts, the projections being disposed on either side of the longitudinal slot of the top wall of the housing and having its outside surfaces embraced by the inner end faces of the arms of respective elastic contacts when they are open.

Each elastic contact is preferably provided with a T-shaped leg cantilevered to the lower wall of the housing and having ends of a horizontal portion thereof terminating in the U-shaped elastic arms symmetrical with respect to the vertical portion of the leg and having the inner end faces thereof engageable with outside end faces of the projections made on one wall of each recess, the distal ends of the arms being bent towards each other.

The invention makes it possible to simplify the design of the zero insertion force electrical connector, increase the number of contacts in the connector, improve its reliability and prolong life of the connector.

BRIEF DESCRIPTION OF DRAWINGS

The invention will now be described with reference to a specific embodiment shown in the accompanying drawings, in which.

INVENTION DESCRIPTION OF THE PREFERRED EMBODIMENT

Figure 3:
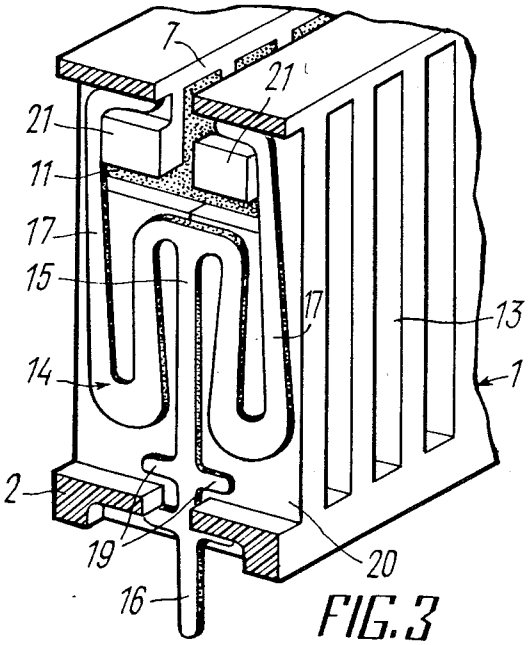
FIG. 3 illustrates a cross-sectional view of a connector with an open contact, according to the invention.

A zero insertion force electrical connector comprises an insulator housing 1 (FIG. 1) having its lower wall 2 secured to a cross connection board 3 by brackets 4 and screws 5. Made in a top wall 6 of the housing 1 is a longitudinal slot 7 for receiving a member being switched, e.g. a printed circuit board 8. The connector also comprises a key 9 made, e.g., in the form of a flat rod having at least one ellipsoidal projection 10 whose opposing lateral curved edges are symmetrical with respect to the longitudinal axis of the rod. Made in the housing 1 is a longitudinal passageway 11 in which the key 9 moves in a direction shown by an arrow 12. Symmetrical recesses 13 for receiving elastic contacts 14 (FIGS. 2, 3) are provided in side walls of the housing 1.

Each contact 14 has a T-shaped leg 15 cantilevered to the lower wall 2 of the housing 1 and having a tail 16 for soldering the contacts. The ends of the horizontal portion of the leg 15 terminate in U-shaped elastic arms 17 symmetrical with respect to the vertical portion of the leg 15. Distal ends 18 of the arms 17 are bent towards each other. The cross-sectional area of the leg 15 is smaller than that of each arm 17. Projections 19 for securing the contacts 14 to the lower wall 2 of the casing 1 are provided in the lower portion of the leg 15.

In order to hold the arms 17 open, projections 21 are provided on a wall 20 (FIGS. 2, 3) of the recess 13 facing towards the end portion of the key 9 (FIG. 4) as it moves in the longitudinal passageway 11 in the direction shown by the arrow 12.

The zero insertion force electrical connector according to the invention functions as follows.

Figure 1:
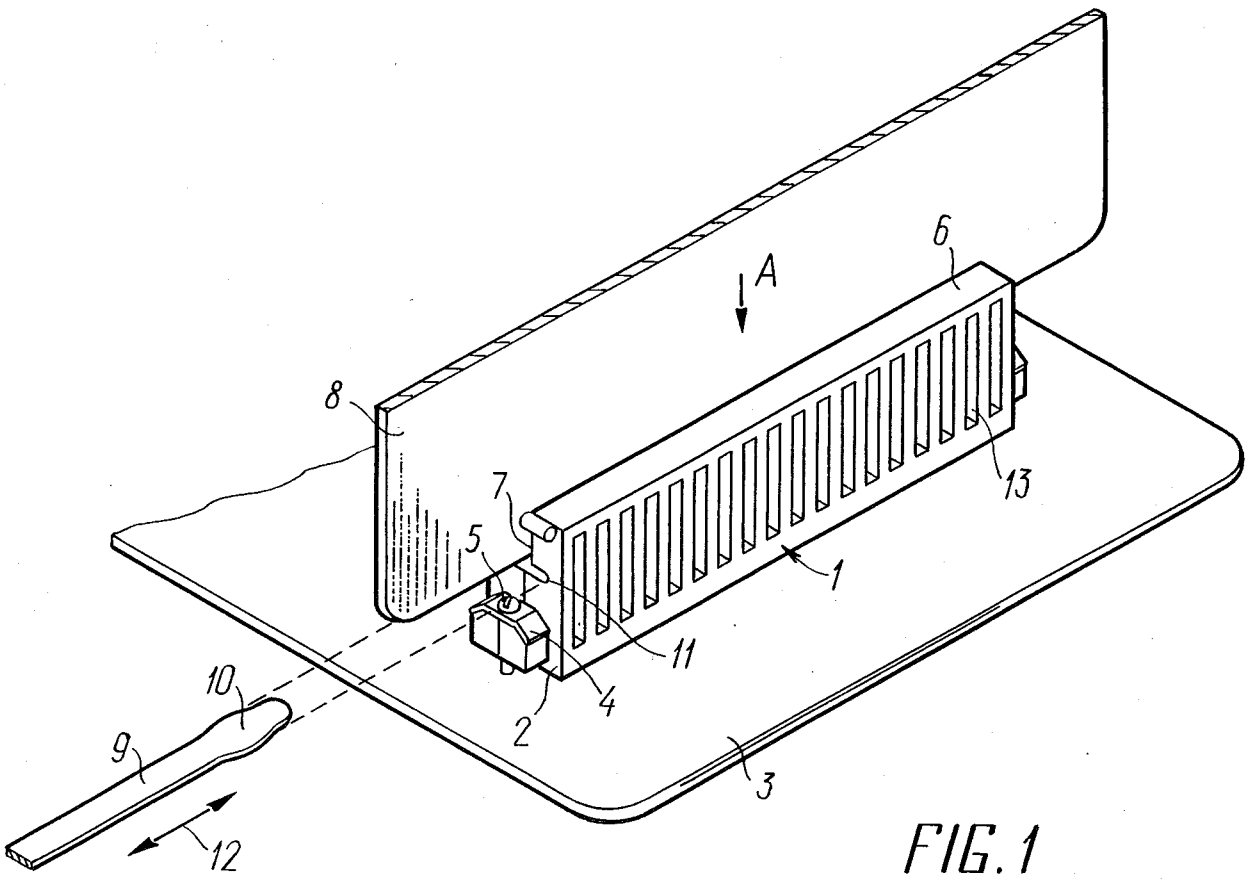
FIG. 1 illustrates a general view of a zero insertion force electrical connector mounted on a cross connection board, shown with a circuit board being switched connected thereto, according to the invention.
Figure 2:
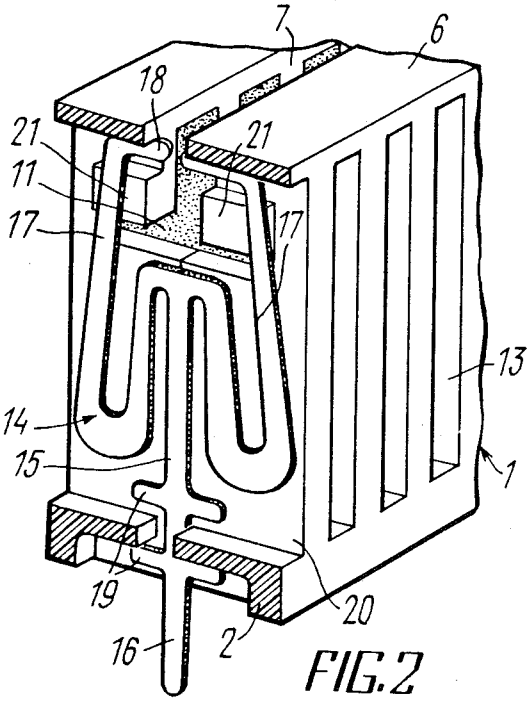
FIG. 2 illustrates a cross-sectional view of an elastic contact mounted loose in a recess of a housing, according to the invention.

To install the printed circuit board 8 (FIG. 1) in the longitudinal slot 7, the key 9 is inserted into the passageway 11. The projection 10 of the key 9 engages with the inner end faces of the arms 17 of the contacts 14 (FIG. 3) to spread the arms 17 and shift them by the longitudinally directed force in the direction of movement of the key 9 (FIG. 1) so that the arms 17 (FIG. 3) embrace the outer periphery of the projections 21. During further movement of the key 9 (FIG. 4) in the passageway 11, it successively engages two-three contacts 14 with its projections 10 only until all contacts 14 of the connector are opened. After that the circuit board 8 being switched is inserted into the longitudinal slot 7 (FIG. 1). To close the contacts 14 (FIG. 2) of the connector, movement of the key 9 (FIG. 4) is reversed. The projection 10 of the key 9 successively spreads the arms 17 (FIG. 2) of the contacts 14 so as to move them away from the projections 21 and to close the contacts 14. The distal bent ends 18 of the arms 17 connect to printed conductors of the circuit board 8 (FIG. 1) under the elastic deformation forces.

Figure 4:
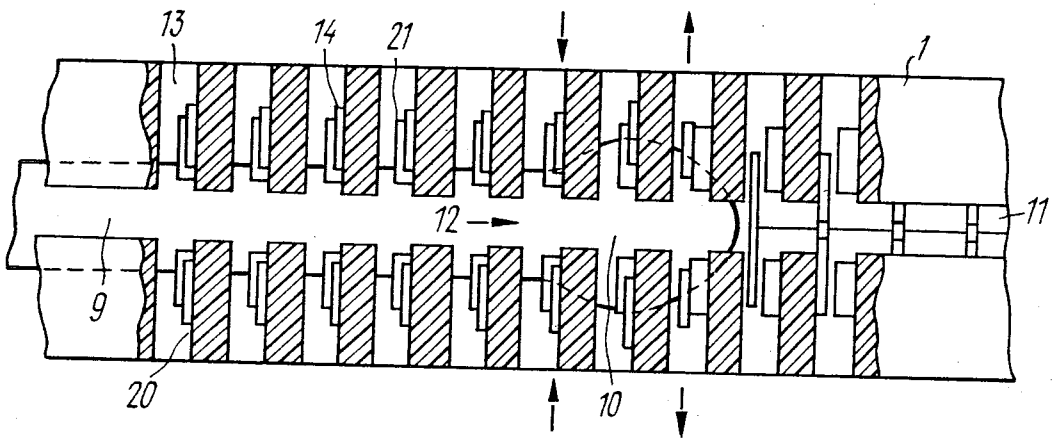
FIG. 4 illustrates a connector at the moment when the contacts are opened, a top view taken along an arrow A in FIG. 1, partially in section, according to the invention.

In order to withdraw the circuit board 8 from the connector, the key 9 is moved in the passageway 11 in the direction shown by the arrow 12 until all contacts 14 are opened, the key 9 being moved with a constant force equal to the force of opening of two-three contacts 14 (FIG. 4).

The key 9 may have several projections 10 made on certain portions thereof. In this case, the key 9 may function as a member for switching electrical circuits since during both forward and backward movement of the key 9 the contacts 14 of the connector will be divided into groups of closed and open contacts 14.

Provision of the key 9 in the form of a flat rod having the ellipsoidal working portion 10 cooperating during opening and closure of contacts with maximum one-three contacts 14 makes it possible to minimize, and make constant, the force of opening and closing of the contacts 14 which enables connectors having a large number of contacts 14 to be provided.

Provision of the projections 21 (FIG. 2) ensures that the inner end faces thereof embrace one by one the open arms 17 of the elastic contacts 14 which makes it possible to insert the printed circuit board 8 (FIG. 1) being switched into the longitudinal slot 7 with zero force when all contacts 14 are open.

Provision of the elastic contact 14 (FIG. 2) with the T-shaped elastic leg 15 whose distal upper ends form the U-shaped arms 17 which are symmetrical with respect to the leg 15 and whose distal ends 18 are bent towards each other ensures both axial and transverse flexibility and mobility of the contact 14.

The axial mobility of the contact 14 ensures placing one by one the arms 17 of the contacts 14 on the projections 21 made on the wall 20 of each recess 13 facing towards the key 9 (FIG. 4) moving in the direction shown by the arrow 12 or moving the arms 17 (FIG. 3) of the contacts 14 one by one away from the projections 21 when the key 9 is moved in the backward direction.

The transverse mobility of the contact 14 ensures a constant contact pressure, hence, constant resistance of the contacts 14 in operation under vibrations and shocks.

The zero insertion force electrical connector according to the invention has a simple design, requires a reduced amount of materials, has an improved reliability and repairability.

We claim:

1. A zero insertion force electrical connector comprising:

an insulator housing having a top wall, a lower wall and side walls;

a longitudinal slot in said top wall of said housing for receiving a member being switched, said side walls of said housing having recesses;

elastic contacts placed in said recesses and having inner end faces, said housing having a longitudinal passageway;

a key ensuring opening of said elastic contacts during its movement in said longitudinal passageway in one direction and closure of said elastic contacts during its movement in the opposite direction, said key being in the form of a rod, said rod having one at least one ellipsoidal projection provided on at least one end portion of said rod which has opposing lateral curved edges symmetrical with respect to the longitudinal axis of said rod and cooperating with said inner end faces of said elastic contacts when said key is moved;

a wall of each of said recesses facing towards said end portion of said rod when said key is moved in said direction in which opening of said elastic contacts is provided; and projections provided on said wall of each of said recesses and disposed on both sides of said longitudinal slot of said top wall of said housing; an outer periphery of said projections being embraced by said inner end faces of said elastic contacts when they are open.

2. A zero insertion force electrical connector according to claim 1, wherein each said elastic contact has:

a T-shaped leg cantilevered to said lower wall of said housing having horizontal and vertical portions and;

U-shaped elastic arms symmetrical with respect to said vertical portion of said leg and terminating in said horizontal portion of said leg; the inner end faces of said elastic arms being engageable with said outer periphery of said projections of said recesses; and the distal ends of said elastic arms being bent towards each other.

* * * * *